US006598332B1

(12) United States Patent
Jibiki

(10) Patent No.: US 6,598,332 B1
(45) Date of Patent: Jul. 29, 2003

(54) RIFLESCOPE WITH ADJUSTABLE EYEPIECE

(75) Inventor: Ubao Jibiki, Kawasaki (JP)

(73) Assignee: Hakko Co., LTD, Tokyo (JP)

( * ) Notice: Subject to any disclaimer, the term of this patent is extended or adjusted under 35 U.S.C. 154(b) by 0 days.

(21) Appl. No.: 09/790,035

(22) Filed: Feb. 20, 2001

(30) Foreign Application Priority Data

Feb. 25, 2000 (JP) ..... 2000-048648

(51) Int. Cl.[7] ..... F41G 1/38
(52) U.S. Cl. ..... 42/119; 42/122
(58) Field of Search ..... 42/119, 122, 124

(56) References Cited

U.S. PATENT DOCUMENTS

| | | | | |
|---|---|---|---|---|
| 2,946,255 A | | 7/1960 | Bolay | |
| 3,058,391 A | * | 10/1962 | Leupold | |
| 3,161,716 A | * | 12/1964 | Burris et al. | |
| 3,297,389 A | * | 1/1967 | Gibson | 350/10 |
| 3,392,450 A | | 7/1968 | Herter et al. | |
| 3,407,302 A | | 10/1968 | Bouwers | |
| 3,464,757 A | | 9/1969 | Schmidt | |
| 3,506,330 A | * | 4/1970 | Allen | 350/10 |
| 3,509,344 A | | 4/1970 | Bouwers | |
| 3,529,882 A | | 9/1970 | Schmidt | |
| 3,712,702 A | | 1/1973 | Schmidt | |
| 3,896,466 A | | 7/1975 | Korpert | |
| 3,971,933 A | | 7/1976 | Adamson | |
| 4,000,419 A | | 12/1976 | Crost | |
| 4,200,355 A | * | 4/1980 | Williams, Jr. | 350/10 |
| 4,241,252 A | | 12/1980 | Litman | |
| 4,255,013 A | | 3/1981 | Allen | |
| 4,341,022 A | | 7/1982 | Santoro | |
| 4,440,476 A | | 4/1984 | Jacobson | |
| 4,582,400 A | | 4/1986 | Lough | |
| 4,584,776 A | * | 4/1986 | Shepherd | 350/550 |
| 4,776,126 A | | 10/1988 | Williams | |
| 4,822,994 A | | 4/1989 | Johnson | |
| 4,952,041 A | * | 8/1990 | Sandall | 350/560 |
| 4,961,278 A | | 10/1990 | Johnson | |
| 5,180,875 A | * | 1/1993 | Berry, Jr. et al. | 42/101 |
| 5,218,479 A | | 6/1993 | Chiou | |
| 5,388,005 A | | 2/1995 | Wilson | |
| 5,532,883 A | | 7/1996 | Fukino | |
| 5,764,410 A | | 6/1998 | Jibiki | |
| 6,131,294 A | | 10/2000 | Jibiki | |

FOREIGN PATENT DOCUMENTS

| | | |
|---|---|---|
| CA | 789817 | 7/1968 |
| DE | 3538023 A1 | 4/1987 |
| EP | 193236 A1 | 9/1986 |
| EP | 267164 A2 | 5/1988 |
| GB | 2135789 A | 9/1984 |
| JP | 8-334703 | 8/1996 |

OTHER PUBLICATIONS

Hakko Co., Ltd., "Vision All Mark III Day & Night Scopes" (sales literatures), published in Japan Sep. 1997 (2 pages).

* cited by examiner

*Primary Examiner*—Stephen M. Johnson
(74) *Attorney, Agent, or Firm*—Stephen Donovan

(57) ABSTRACT

A riflescope capable of distance adjustment without arm stretching with improved precision and operability during a distance setting operation comprising a distance adjustment unit 30 equipped with a distance adjustment lens 31 disposed between an object lens and an erector lens 60. The riflescope can also have a distance adjustment unit 10 equipped with a distance adjustment ring 11 disposed in the vicinity of an eyepiece tube 3 equipped with an eyepiece optical system. The riflescope can also have a connector 50 which connects together distance adjustment unit 30 and distance adjustment operation unit 10. The riflescope is capable of distance adjustment by operation of a distance adjustment operation ring 11.

5 Claims, 4 Drawing Sheets

RIFLESCOPE WITH ADJUSTABLE EYEPIECE

This application claims priority to Japanese patent application P000225-01 (2000-048648), as filed with the Japanese patent office on Feb. 25, 2000.

BACKGROUND OF THE INVENTION

The present invention relates to a riflescope for mounting upon a hunting rifle or a rifle used for sport, amusement, etc.

An earlier technology type riflescope for mounting upon a hunting rifle or a rifle used for sport, amusement, etc. comprises: an objective lens; an objective tube containing the objective lens; a distance adjustment lens disposed in the vicinity of the objective tube; a vertical sighting adjustment ring; a right-left sighting adjustment ring; and a sighting adjustment unit containing the vertical sighting adjustment ring and the right-left sighting adjustment ring; wherein the sighting adjustment unit is disposed at the objective end of the riflescope. The distance adjustment lens moves forward and backward due to operation of a distance adjustment ring so that distance adjustment is carried out.

BRIEF SUMMARY OF THE INVENTION

Since the earlier technology type distance adjustment ring used for distance adjustment is disposed at the objective side of the sighting adjustment unit equipped with the vertical sighting adjustment ring and the right-left sighting adjustment ring, fine distance adjustment can only be carried out while extending one hand. Therefore problems arise such as ready movement during distance adjustment, difficulty of distance adjustment, and worsening of precision of distance adjustment. Moreover, the scale used for the distance adjustment operation is disposed upon the distance adjustment operation ring at the lateral surface of the riflescope. Therefore during distance adjustment the scale is viewed, and rough distance adjustment is carried out. Thereafter distance adjustment must be carried out without looking at the scale. This operation is deficient in that the operation therefore becomes difficult.

In order to solve the above mentioned problems, the riflescope of the present invention comprises: a distance adjustment unit comprising a distance adjustment lens between an objective lens and an erector lens; a distance adjustment operation unit comprising a distance adjustment operation ring in the vicinity of an eyepiece tube equipped with an eyepiece optical system; and a connector member connecting the distance adjustment unit and the distance adjustment operation unit so that distance adjustment of the riflescope can be carried out by operation of the distance adjustment operation ring.

A scale used for distance adjustment is disposed upon the distance adjustment operation ring so as to be visible from the eyepiece-proximal end of the riflescope.

Moreover, the connector member is formed as a long and narrow plate.

Furthermore, the riflescope further comprises: a distance adjustment lens tube fixed to the distance adjustment unit; and a distance adjustment lens holding tube holding the distance adjustment lens within this distance adjustment lens tube so that the distance adjustment lens holding tube is capable of forward-backward movement.

The riflescope further comprises: a fixed tube fixed within the distance adjustment operation unit; a rotatable cam tube covering this fixed tube; and a cam mechanism for forward-backward movement of the connector member when the cam tube is rotated.

Moreover, the riflescope further comprises: a focus inside gear within the distance adjustment operation ring so that the focus inside gear rotates together with the distance adjustment operation ring; a focus gear covering the cam tube so that the focus gear rotates together with the cam tube; an idler gear disposed between the focus inside gear and the focus gear, having different gears ratios therewith, and engaging therewith.

BRIEF DESCRIPTION OF THE DRAWINGS

A working embodiment of the present invention is explained below by the use of illustrations of a riflescope.

DETAILED DESCRIPTION OF THE INVENTION

Figure 1:
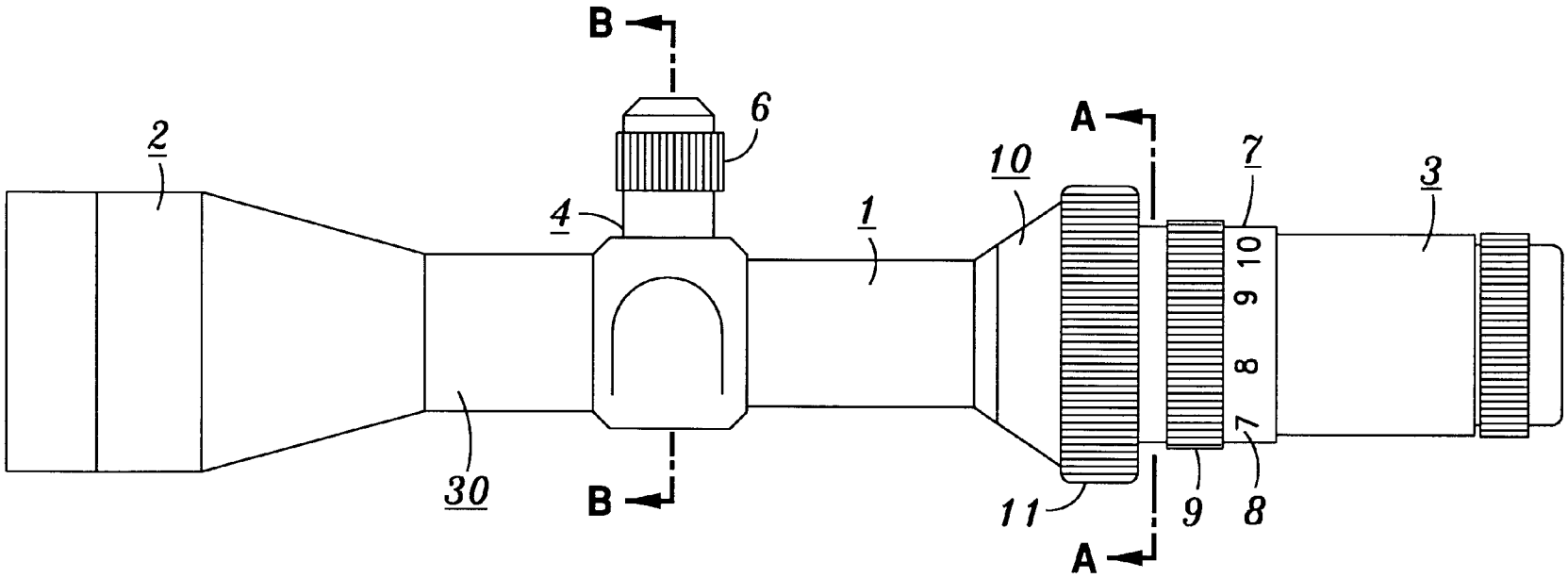
FIG. 1 is a side view of the riflescope of the present invention.
Figure 3:
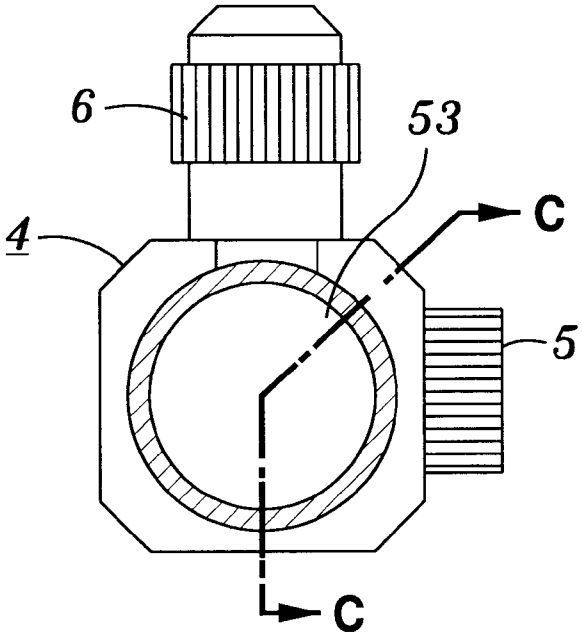
FIG. 3 is a cross-sectional view of the B—B line of the riflescope shown in FIG. 1.
Figure 2:
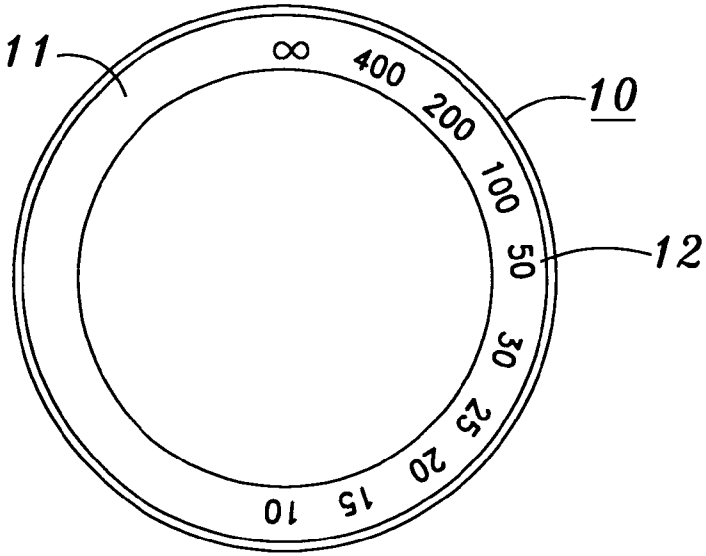
FIG. 2 is a simplified eyepiece-end view of the eyepiece tube equipped with the eyepiece optical system as seen from the A—A line of the riflescope shown in FIG. 1.
Figure 4:
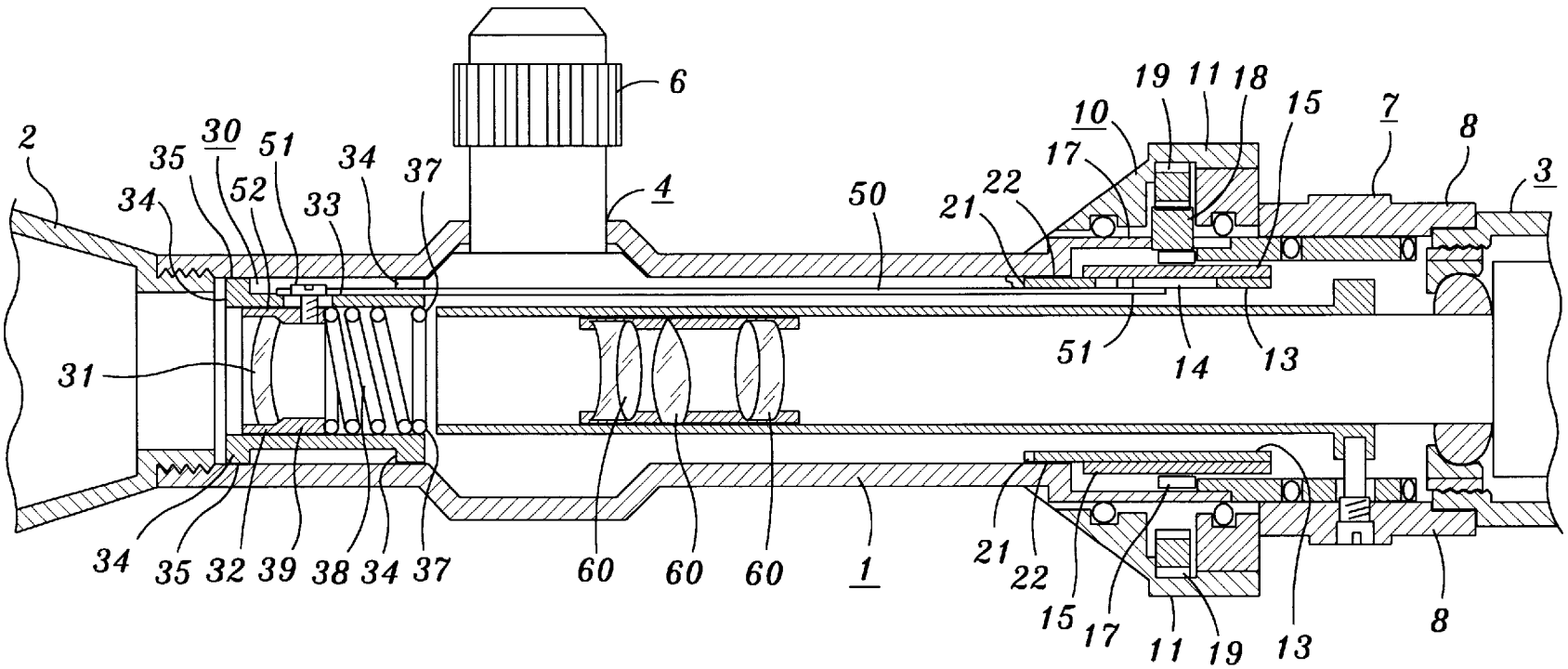
FIG. 4 is a simplified lateral view showing major parts of the sighing telescope across the C—C cross section shown in FIG. 3.
Figure 5:
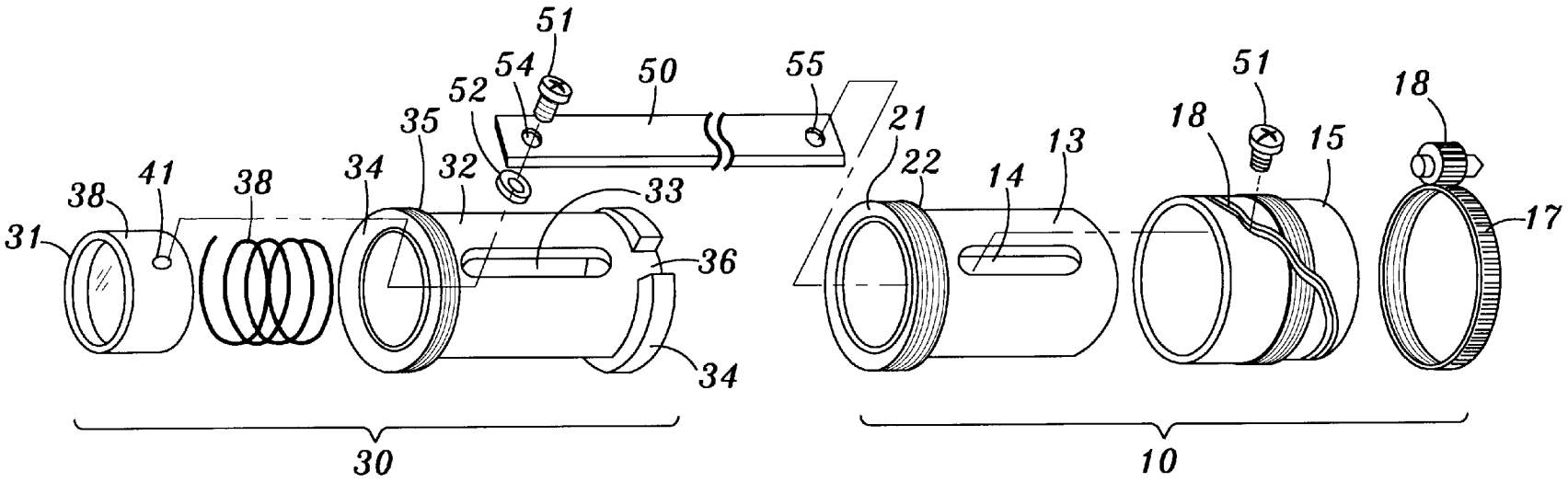
FIG. 5 is an exploded tilted-perspective view of the construction of the distance adjustment mechanism of the riflescope of the present invention. Furthermore, the riflescope of the present working embodiment is a riflescope for right-handed use.

My invention will now be discussed in relation to FIGS. 1–5 where the following parts are indicated:

1 . . . riflescope body
2 . . . objective tube
3 . . . eyepiece tube
4 . . . sighting adjustment member
5 . . . left-right adjustment ring
6 . . . vertical sighting adjustment ring
7 . . . magnification setting operation unit
8 . . . magnification setting ring
9 . . . scale
10 . . . distance adjustment operation unit
11 . . . distance adjustment operation ring
12 . . . scale
13 . . . fixed tube
14 . . . guide groove
15 . . . cam tube
16 . . . cam tube groove
17 . . . focus gear
18 . . . idler gear
19 . . . focus inside gear
21 . . . flange
22 . . . male thread
30 . . . distance adjustment unit
31 . . . distance adjustment lens
32 . . . distance adjustment lens tube
33 . . . guide groove
34 . . . flange
35 . . . male thread
36 . . . cutout region
37 . . . inwardly extending flange
38 . . . spring

39 . . . distance adjustment lens holding tube
41 . . . connector pin mounting hole
50 . . . connector
51 . . . connector pin
52 . . . intermediate tube or washer
53 . . . for-connector-use groove
51 . . . connector pin insertion hole
55 . . . connector pin mounting hole
60 . . . erector lens Thus the riflescope of the present invention is provided with an objective tube 2 having an objective lens system at one end of the riflescope body 1. An eyepiece optical system is provided in an eyepiece tube 3 at the opposite end of riflescope body 1. At roughly the center of riflescope body 1 is provided sighting adjustment unit 4 for carrying out deviation angle adjustment, elevation angle adjustment, etc. for adjustment of the optical axis of riflescope body 1 toward the pointing direction of the rifle according to actual shooting conditions. On the right side of this sighting adjustment unit 4 is provided rotatable left-right adjustment ring 5 for deviation angle adjustment. Upon the top of this sighting adjustment unit 4 is provided rotatable vertical sighting adjustment ring 6 for elevation angle adjustment. Moreover, at the far end of the eyepiece of riflescope body 1 is provided a magnification setting operation unit 7 capable of setting magnification. Magnification setting operation unit 7 is equipped with a magnification setting ring 8. An erector lens 60 disposed at roughly the center of the riflescope body is moved by operation of this magnification setting ring 8. Furthermore, a scale 9 is provided at the eyepiece end of magnification setting ring 8 so that magnification can be set while viewing this scale 9.

Distance adjustment of the riflescope is carried out by means of a distance adjustment mechanism. For the present invention the distance adjustment mechanism comprises distance adjustment operation unit 10 for carrying out distance adjustment and distance adjustment unit 30 for carrying out actual distance adjustment. Distance adjustment operation unit 10 is disposed in the vicinity of the objective side of magnification adjustment operation member 7. Distance adjustment unit 30 is disposed between the objective lens and an erector lens 60. Distance adjustment operation unit 10 is equipped with a distance adjustment operation ring 11. Diameter of distance adjustment operation unit 10 is larger than the diameter of the riflescope body. A scale 12 is provided for distance adjustment at the eyepiece end of this distance adjustment operation ring 11. This scale 12 can be seen while looking through the eyepiece lens.

A fixed tube 13 is provided within distance adjustment operation ring 11. A flange 21 is provided at the objective side of this fixed tube 13. A male thread 22 is formed upon the outer perimeter of this flange 21 and engages with a female thread formed inside distance adjustment operation unit 10. Fixed tube 13 is fixed within riflescope body 1. Moreover, a guide groove 14 is formed parallel with the optical axis in fixed tube 13. This guide groove 14 is fixed within riflescope body 1 so as to position guide groove 14 at a 45° angle to the upper right within riflescope body 1. Furthermore, a rotatable cam tube 16 is provided within fixed tube 13 so as to cover fixed tube 13. A cam mechanism comprises a spiral cam groove 16 formed in this cam tube 15 and a connector 50 connecting cam tube 15 between distance adjustment operation unit 10 and distance adjustment unit 30. Moreover, a rotatable focus gear 17 covers the approximate center of cam tube 15 so as to rotate together as a single unit with cam tube 15. This focus gear 17 can be rotated by operation of distance adjustment operation ring 11. Furthermore, focus gear 17 and cam tube 15 are attached together.

A rotatable focus inside gear 19 is provided within distance adjustment operation ring 11 so as to rotate as a single unit with distance adjustment operation ring 11. A gap is provided between this focus inside gear 19 and the above mentioned focus gear 17. An idler gear 18 is disposed in the upper portion of this gap above focus gear 17. Teeth of this idler gear 18 engage teeth of focus ear 17. Teeth of this idler gear 18 also engage teeth of focus inside gear 19. Rotation of idler ear 18 by focus inside gear 19 is adjusted so that focus gear 17 rotates smoothly.

Distance adjustment unit 30, which is driven by distance adjustment operation unit 10, is constructed as described below. A distance adjustment lens tube 32 is provided within this distance adjustment unit 30. This distance adjustment lens tube 32 is formed as a tubular body having flanges 34 at both ends along the optical axis. At the objective side of this distance adjustment lens tube 32 is formed a male thread 35 upon the outer perimeter of flange 34 at the objective end of this distance adjustment lens tube 32. This male thread 35 engages a female thread formed within distance adjustment unit 30 and fixes distance adjustment unit 30 within riflescope body 1. Moreover, a guide groove 33 is formed parallel to the optical axis and upon distance adjustment lens tube 32. This guide groove 33 is disposed so as to fix distance adjustment lens tube 32 within riflescope body 1 positioned at a 45° angle to the upper right. Furthermore, a cutout region 36 is formed along the direction of extension of this guide groove 33 within flange 34 disposed at the eyepiece end of distance adjustment lens tube 32 so that connector 50 can be positioned within cutout region 36 so as to connect together distance adjustment operation unit 10 and distance adjustment member 30.

An inwardly extending flange 37 is provided at the interior eyepiece end of distance adjustment lens tube 32. A spring 38 is provided within distance adjustment lens tube 32. This spring 38 abuts against inwardly extending flange 37. Furthermore, a forward-backward moveable distance adjustment lens holding tube 39 is provided within distance adjustment lens tube 32. The above mentioned spring 38 abuts against distance adjustment lens holding tube 39. This distance adjustment lens holding tube 39 is equipped with a distance adjustment lens 31 at the objective lens end within distance adjustment lens holding tube 39. This distance adjustment lens holding tube 39 holds distance adjustment lens 31 by adhesion, etc.

Distance adjustment operation unit 10 and distance adjustment unit 30 are connected together by connector 50 formed as a long and narrow plate. One end of connector 50 is positioned above guide groove 33 of distance adjustment lens tube 32 and passes through cutout region 36 formed in distance adjustment lens tube 32. Moreover, a for-connector-use groove 53 is formed at a 45° angle to the upper right interior of riflescope body 1 between distance adjustment operation unit 10 and distance adjustment unit 30. Connector 50 is provided extending along this for-connector-use groove 53. Furthermore, connector 50 is positioning so that the other end of connector 50 is aligned above guide groove 14 formed within fixed tube 13. A connector pin insertion hole 54 is formed at one end of connector 50, and a connector pin 51 having male threads is inserted into connector pin insertion hole 54. This connector pin 51 is inserted into intermediate tube or washer 52 and into guide groove 33 formed within distance adjustment lens tube 32. A connector pin mounting hole 41 is formed in distance adjustment holding tube 39, and connector pin 51 is mounted within connector pin mounting hole 41 so as to connect together distance adjustment lens holding tube 39 and connector 50. A connector pin 51 is also provided on the distance adjustment operation unit 10 side of connector 50. This connector pin 51 is inserted into cam groove 16 of cam tube 15 and guide groove 14 of fixed tube 13. Connector pin 51 is mounted in a connector pin mounting hole 55 formed at the other end of connector 50. Connector 50 forms a cam mechanism for forward-backward movement driven by rotation of cam tube 15.

The riflescope of the present invention constructed as described above is operated as described below. Distance adjustment can be carried out by rotational operation of distance adjustment operation ring 11. First while scale 12 provided upon distance adjustment operation ring 11 is viewed from the eyepiece side, distance adjustment operation ring 11 is rotated. Distance adjustment operation ring 11 and focus inside gear 19 rotate together. This focus inside gear 19 and idler gear 18 mesh together so that rotational movement of focus inside gear 19 is transferred to idler gear 18. Furthermore, idler gear 18 and focus gear 17 mesh together so that rotation of idler gear 18 is transferred to focus gear 17 so that focus gear 17 rotates. Moreover, when focus gear 17 and cam tube 15 rotate together, connector pin 51 at the distance adjustment operation unit 10 end moves along cam groove 16 of cam tube 15. During this movement, connector pin 51 is inserted into guide groove 14 of fixed tube 13 so that rotational movement of cam tube 15 becomes forward-backward translation movement of connector pin 50. Connector pin 51 is connected to connector 50 so that connector 50 is moved forward and backward by connector pin 51.

Connector 50 at the distance adjustment unit 30 end is connected to connector pin 51. This connector pin 51 passes through guide groove 33 formed in distance adjustment lens tube 32 and connects to distance adjustment lens holding tube 39 so that forward-backward movement of connector 50 causes forward-backward movement of distance adjustment lens holding tube 39 so that distance adjustment of the riflescope can be performed.

As explained above, the riflescope of the present invention has the distance adjustment unit equipped with the distance adjustment lens between the objective lens and the erector lens. The riflescope of the present invention is also provided with the distance adjustment operation unit equipped with the distance adjustment operation ring in the vicinity of the eyepiece tube equipped with the eyepiece optical system. Distance adjustment of the riflescope can be carried out by operation of the distance adjustment operation ring connected to the connector member connecting the distance adjustment unit and the distance adjustment operation unit. Therefore distance adjustment can be carried out without arm stretching, thereby making distance adjustment easier and more precise. Moreover, construction is comparatively easy since the distance adjustment unit and the distance adjustment operation unit are connected via the connector member. Distance adjustment can be carried out without adversely affecting magnification set by movement of the erector lens by operation of the magnification setting operation ring. Therefore a riflescope can be provided that has excellent precision and is readily operated during distance adjustment.

The scale used for the distance adjustment operation is visible from the eyepiece end of the riflescope upon the distance adjustment operation ring. Therefore distance adjustment can be performed while the scale is viewed. Therefore distance adjustment of the riflescope can be carried out rapidly and precisely.

Since the above mentioned connector member is formed as a thin and narrow plate, the distance adjustment unit and the distance adjustment operation unit can be smoothly connected together within the limited tube interior of the riflescope without adversely affecting the magnification setting function carried out by moving the erector lens by operation of the magnification setting operation ring. Therefore the riflescope having the above mentioned results can be more readily manufactured.

The distance adjustment lens tube is fixed to the distance adjustment unit, and the distance adjustment lens holding tube is provided holding the above mentioned distance adjustment lens within this distance adjustment lens tube so that forward-backward movement is possible. Since this distance adjustment lens holding tube is connected to the above mentioned connector member, positioning of the distance adjustment lens at a prescribed position can be readily carried out.

The fixed tube is fixed within the distance adjustment operation unit. This fixed tube is covered by a rotatable cam tube. Since a cam mechanism is provided which moves the connector member forward and backward upon rotation of this cam tube, rotation of the distance adjustment operation ring can readily and smoothly position the distance adjustment lens at a distant location.

The focus inside gear is provided within the distance adjustment operation unit so that the focus inside gear rotates together with the distance adjustment operation ring. The focus gear covers the above mentioned cam tube so that the focus gear moves together with the cam tube. The idler gear (having different gears ratios with the focus gear and the focus inside gear) is provided between the focus gear and the focus inside gear, and the teeth of the idler gear mesh with those of the focus gear and the focus inside gear. Therefore the focus gear and the focus inside gear can be smoothly connected together by the idler gear. Therefore the distance adjustment lens can be easily and smoothly positioned at a distant location.

What is claimed is:

1. A riflescope comprising:

a distance adjustment unit comprising a distance adjustment lens between an objective lens and an erector lens;

a distance adjustment operation unit comprising a distance adjustment operation ring in the vicinity of an eyepiece tube equipped with an eyepiece optical system; and a connector member connecting the distance adjustment unit and the distance adjustment operation unit so that distance adjustment of the riflescope can be carried out by operation of the distance adjustment operation ring, wherein the connector member is formed as a long a narrow plate.

2. The riflescope of claim 1 wherein a scale used for distance adjustment is disposed upon the distance adjustment operation ring so as to be visible from the eyepiece end of the riflescope.

3. The riflescope of claim 1 wherein the riflescope further comprises:

a distance adjustment lens tube fixed to the distance adjustment unit; and a distance adjustment lens holding tube holding the distance adjustment lens within this distance adjustment lens tube so that the distance adjustment lens holding tube is capable of forward-backward movement.

4. The riflescope of claim 1 wherein the riflescope further comprises:

a fixed tube fixed within the distance adjustment operation unit;

a rotatable cam tube covering this fixed tube; and a cam mechanism for forward-backward movement of the connector member then the cam tube is rotated.

5. The riflescope of claim 4 wherein the riflescope further comprises:

a focus inside gear within the distance adjustment operation ring so that the focus inside gear rotates together with the distance adjustment operation ring;

a focus gear covering the cam tube so that the focus gear rotates together with the cam tube;

an idler gear disposed between the focus inside gear and the focus gear, having different gears ratios therewith, and engaging therewith.

* * * * *